United States Patent [19]

Elze

[11] Patent Number: 4,799,273

[45] Date of Patent: Jan. 24, 1989

[54] PATIENT MOVING MEANS FOR HOSPITAL BED

[76] Inventor: Karl H. Elze, 300 S. Carson Meadow Drive, 15, Carson City, Nev. 89701

[21] Appl. No.: 144,481

[22] Filed: Jan. 15, 1988

[51] Int. Cl.[4] ..... A61G 7/08

[52] U.S. Cl. ..... 5/81 R; 5/81 B

[58] Field of Search ..... 5/81 R, 81 B, 81 C, 5/88, 187, 189, 230

[56] References Cited

U.S. PATENT DOCUMENTS

| | | | |
|---|---|---|---|
| 1,082,177 | 12/1913 | Skeffington | 5/88 |
| 3,364,506 | 1/1968 | Hale | 5/81 R |
| 3,383,717 | 5/1968 | Underwood | 5/88 X |
| 3,962,736 | 6/1976 | Fedele | 5/81 R |
| 4,156,946 | 6/1979 | Attenburrow | 5/81 R |
| 4,202,064 | 5/1980 | Joergensen | 5/88 X |
| 4,680,818 | 7/1987 | Ooka et al. | 5/81 R |
| 4,730,356 | 3/1988 | Suzuki | 5/187 |

*Primary Examiner*—Ramon O. Ramirez
*Attorney, Agent, or Firm*—Richard C. Litman

[57] ABSTRACT

An apparatus is provided for moving a patient toward the head of a bed without touching or lifting him. An upper canvas upon which the patient rests is detachably secured to a take-up bar at the head of the bed. A lower canvas disposed between the upper canvas and the underlying mattress or cushion has its lower edge secured at the foot of the bed and its head edge pulled toward the head of the bed by a tensioning device. The lower canvas is thus held taut and longitudinal movement thereof is prevented. Since the length of the upper canvas is not limited by the length of the bed, the patient may be moved several times before the device is reset to the start position.

5 Claims, 3 Drawing Sheets

Fig. 3
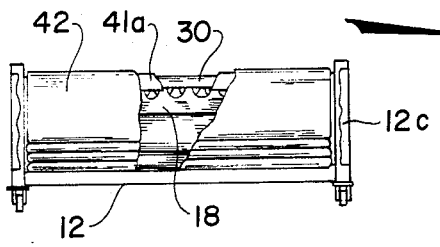
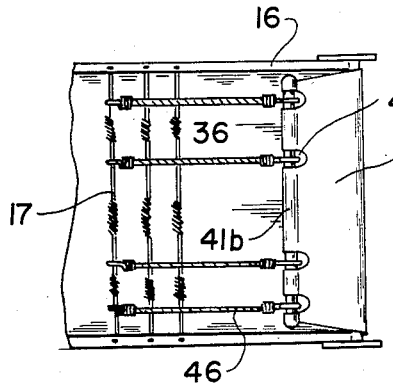
Fig. 4
Fig. 5
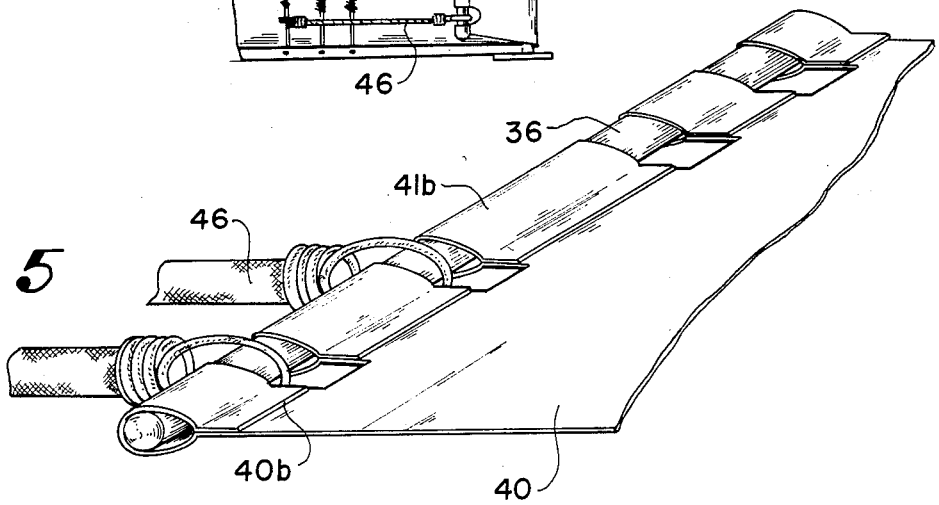

PATIENT MOVING MEANS FOR HOSPITAL BED

BACKGROUND OF THE INVENTION

1. Field of the Invention

This invention relates to hospital beds and specifically to improved means to adjust the position of the patient in the hospital bed.

More particularly, this invention relates to means to move the patient toward the head of the hospital bed by controllable displacement of specially arranged canvas.

2. Description of the Related Art

When patients are occupying hospital beds, there is a tendency for the patient to gravitate toward the foot of the bed. This tendency is exaggerated when the head of the bed is elevated, as it often is, either for patient comfort or to facilitate examination or treatment of the patient. It is therefore necessary to periodically move the patient toward the head of the bed.

Devices for shifting a patient toward the head of the bed are known in the prior art.

U.S. Pat. No. 3,383,717 to Underwood discloses a hospital bed wherein one edge of the bedsheet is secured to a transverse rod rotatably mounted at the head of the bed. When the rod is turned, as by a crank attached thereto, the bedsheet and patient are moved toward the head of the bed.

However, this device and other prior art devices have several disadvantages. First, the patient may be moved only a short distance before the available supply of sheet is exhausted. Furthermore, continually sliding the sheet with the patient thereon along the mattress can result in excessive wear to the mattress cover, and may also produce wrinkles and folds in the mattress cover, with resulting discomfort and irritation to the patient. Finally, this and other prior art devices are not practical for use in cases where a separate and distinct cushion is placed on top of the mattress, as with burn or other highly fragile patients. In such cases, friction between the cushion and the sheet upon which the patient rests would hinder longitudinal movement of the patient, as well as cause excessive wear to the cushion or impart longitudinal movement thereto.

SUMMARY OF THE INVENTION

Accordingly, it is an object of the present invention to provide a device for shifting a patient longitudinally on a bed which is adapted for use with a mattress having additional cushioning means on top thereof, and which is thus adaptable for use with burn patients or other highly fragile patients.

It is another object of the present invention to provide a device for shifting a patient longitudinally on a bed which will ensure that the patient is at all times resting on a smooth, wrinkle-free surface, even when the head of the bed is tilted up.

It is another object of the present invention to provide a device for shifting a patient longitudinally on a bed which provides an essentially unlimited supply of canvas material, avoiding the need for frequent resetting of the device.

It is another object of the present invention to provide means for shifting a patient longitudinally on a bed which will decrease friction and minimize wear to the underlying mattress or cushion.

It is a further object of the present invention to provide means for shifting a patient longitudinally on a bed which can be operated without disturbing a sleeping or comatose patient.

It is a further object of the present invention to provide such means which are detachably securable to existing hospital beds.

In addition to an upper canvas which is detachably secured to a take-up bar by means of which it is drawn toward the head of the bed, the present invention provides a lower canvas which is disposed intermediate the upper canvas and the underlying mattress or cushion and which provides a smooth, unwrinkled surface for the upper canvas to slide upon. The patient rests on special sheeting which is placed on top of the upper canvas. Means are provided whereby the lower canvas is prevented from sliding toward the head of the bed and whereby it remains taut and wrinkle-free.

With these and other objects in view which will more readily appear as the nature of the invention is better understood, the invention consists in the novel construction, combination and arrangements of parts hereinafter more fully described, illustrated and claimed, with reference being made to the appended drawings.

BRIEF DESCRIPTION OF THE DRAWINGS

FIG. 3 is a foot elevation view of the structure of FIG. 1 with portions cut away.

FIG. 4 is a fragmentary bottom plan view of the structure of FIG. 1.

FIG. 5 is an enlarged view of a portion of the structure of FIG. 4.

Similar reference characters refer to corresponding parts throughout the several figures of the drawings.

DESCRIPTION OF THE PREFERRED EMBODIMENT

Figure 1:
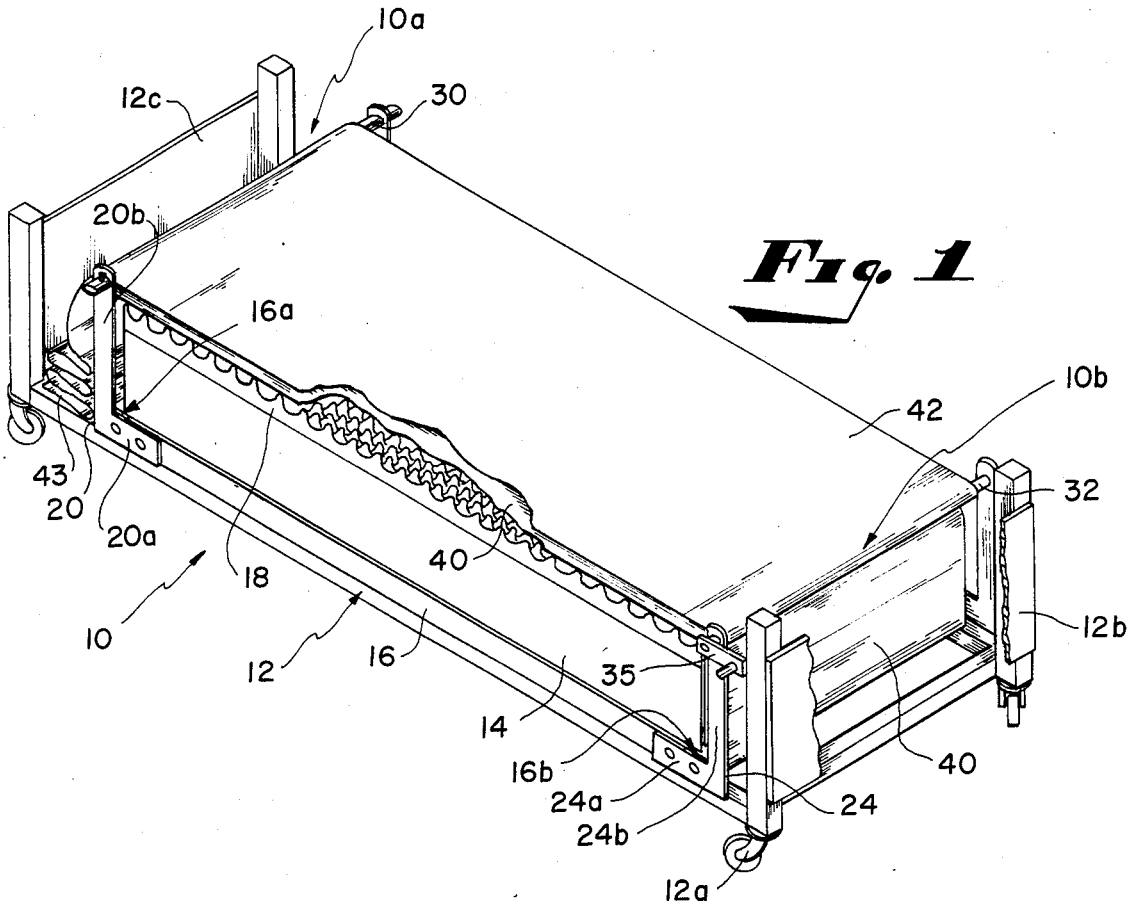
FIG. 1 is a perspective view of a hospital bed incorporating the device of the present invention.

Turning now to the drawings, FIG. 1 shows a hospital bed 10 having a foot portion **10*a* and a head portion 10*b*. Hospital bed 10 includes a bed frame 12 having legs 12*a*, a headboard 12*b*, and a footboard 12*c*. Resting on top of bed frame 12 is mattress frame 16 having foot corners 16*a* and head corners 16*b*. Mattress 14 rests on mattress frame 16. Resting on mattress 14 is cushion 18** comprising egg crate foam or other suitable resiliently deformable foam material, such as is extensively used with burn or other highly fragile patients.

According to the present invention, foot support brackets 20 extend upwardly from foot corners **16*a* of mattress frame 16. Each foot support bracket 20 comprises a horizontal arm 20*a* and a vertical member 20*b*. Vertical members 20*b* are welded or otherwise secured to horizontal arms 20*a*, which are in turn bolted to mattress frame 12. Foot anchor bar 30 is detachably mounted between the two spaced apart foot support brackets 20**.

Figure 7:
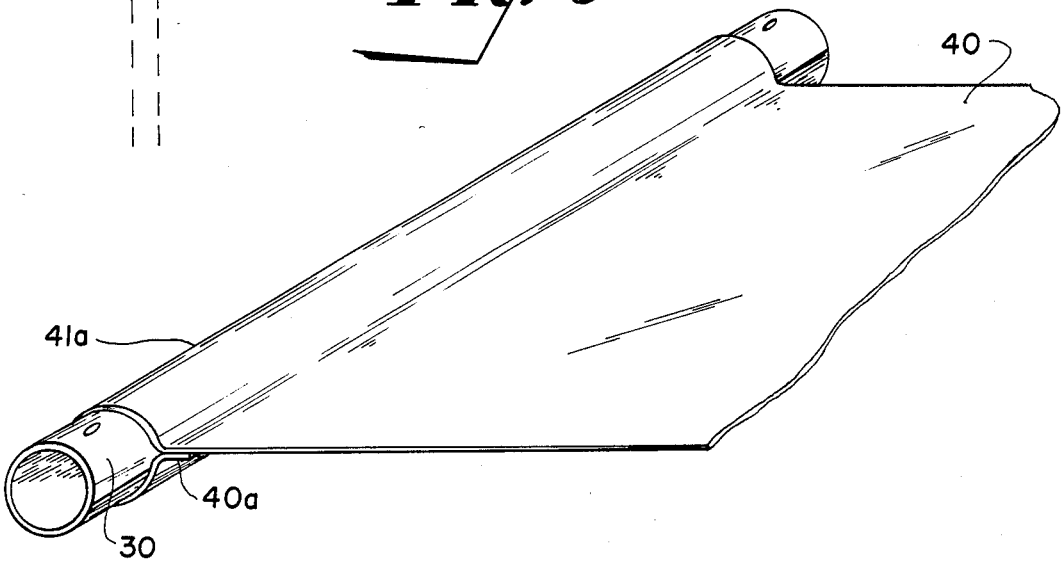
FIG. 7 is an enlarged perspective view of the foot end of the lower canvas and the foot anchor bar.

A lower canvas 40 has a foot edge **40*a* and a head edge 40*b*. Foot edge 40*a* is furnished with a foot hem 41*a* and head edge 40*b* is furnished with a head hem 41*b*. As shown in FIG. 7, foot anchor bar 30 is passed through foot hem 41*a* and then secured between foot support brackets 20. The foot edge 40*a*** of lower sheet 40 is thus held firmly in place, preventing lower canvas 40 from moving toward the head of the bed.

The head edge 40*b* of lower sheet 40 is passed between mattress frame 16 and bed frame 12 and is secured to mattress frame 16 by means of the arrangement shown in FIGS. 4 and 5. As can be seen, tension rod 36 is passed through head hem 41*b* of head edge 40*b*. One end of each bungi cord 46 is then secured to tension rod 36 through cut out portions 41*c* of head hem 41*b*. The other end is secured to springs 17 of mattress frame 16. Lower canvas 40 is thus held taut and wrinkle-free, even if the head of bed 10 is tilted up, and provides a smooth surface over which upper canvas 42, with the patient thereupon, can be slid. A suitable lubricant, such as talcum powder or silicone, can be sprinkled between canvas 40 and 42 in order to reduce friction therebetween.

Figure 2:
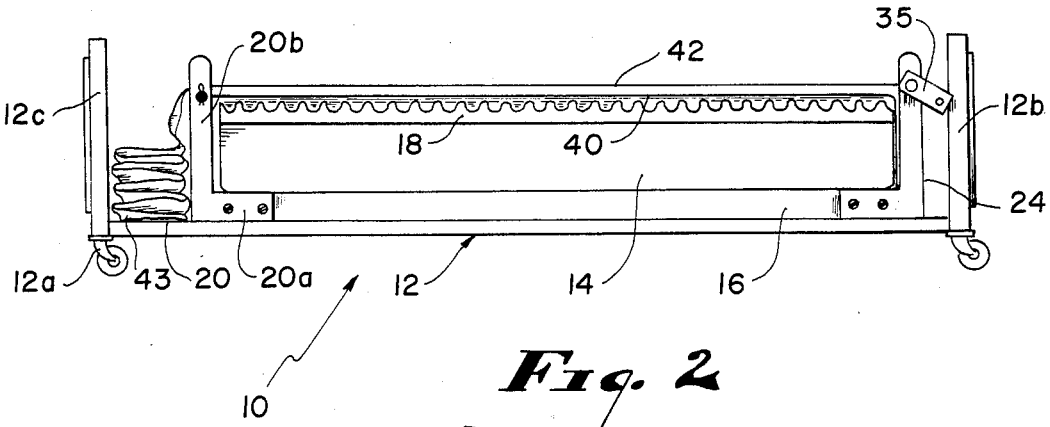
FIG. 2 is a right side view of the structure of FIG. 1.

Turning now to upper canvas 42, FIGS. 1 and 2 show head support brackets 24, which comprise horizontal arms 24*a* welded to vertical members 24*b*, extending upwardly from head corner supports 16*b* of bed frame 12. Horizontal arms 24*a* are secured to bed frame 12 by suitable means such as bolts.

Figure 6:
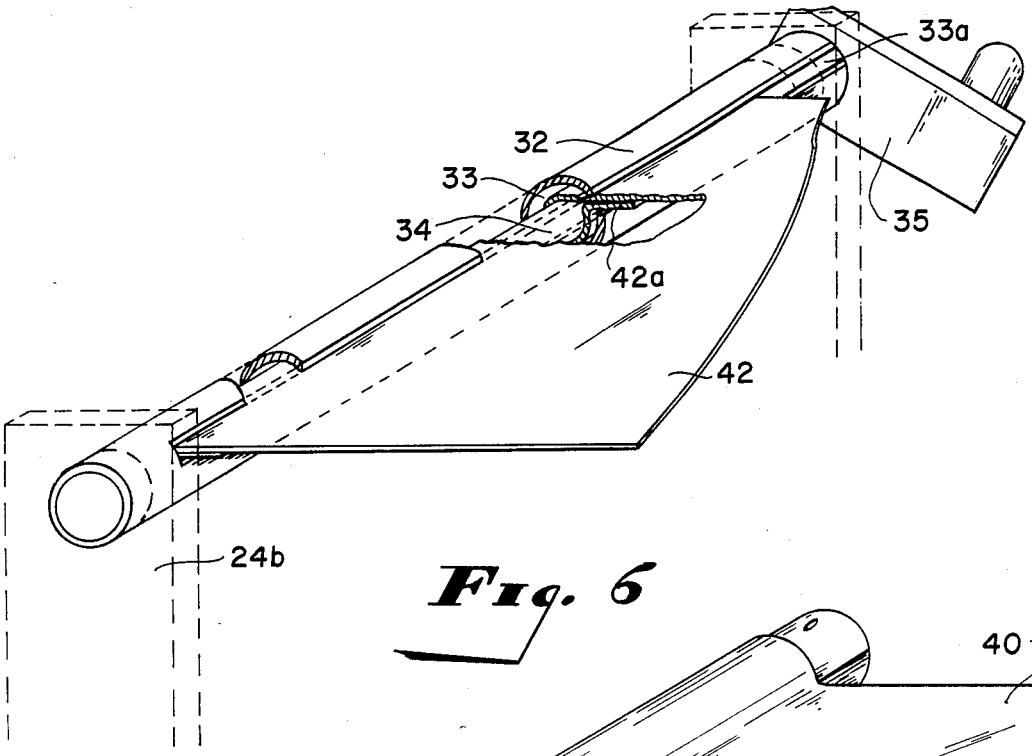
FIG. 6 is an enlarged perspective view of the head end of the upper canvas and the take-up bar.

As shown in FIG. 6, take-up bar 32 is rotatably and detachably mounted between the two head support brackets 24. Take-up bar 32 has a concentric bore 33 therethrough and a slot 33*a* communicating between bore 33 and the exterior of take-up bar 32. A round key 34 having a diameter slightly more than that of bore 33 is removably insertable thereinto. Key bar 34 is passed through head hem 42*a* of upper canvas 42 and then inserted into bore 33. Upper canvas 42 thus extends through slot 33*a* and is wrapped around take-up bar 32 when take-up bar 32 is rotated, as by an end mounted crank 35. Alternatively, a motor driven mechanism may be used to turn take-up bar 32.

As shown in FIGS. 1 and 2, foot edge 43 of upper canvas 42 is allowed to drape over foot anchor bar 30 and to festoon or otherwise collect on bed frame 12 between foot board 12*c* and mattress 14. In practice, upper canvas 42 may be considerably longer than mattress 16, enabling the patient to be moved toward the head of the bed several times before upper canvas 42 is brought back to the start position. The sheeting on which the patient rests itself rests on top of upper canvas 42, and may be secured thereto by appropriate means such as clips. As upper canvas 42 is taken up on take-up bar 32, this sheeting is allowed to drape over take-up bar 32 and collect between mattress 16 and headboard 12*b*.

Both lower canvas 40 and upper canvas 42 can be formed from commercially available material such as Destiny 2+2.

As can be seen from the foregoing, lower canvas 40, when installed according to the present invention, will provide a smooth, wrinkle-free surface over which upper canvas 42, with the patient thereupon, may be drawn toward the head of the bed. Since the foot edge 40*a* of lower canvas 40 is securely fixed at the foot of bed 10, lower canvas 40 cannot itself be drawn toward the head of the bed. It thus protects the underlying surface, whether it be the mattress 14 or cushion 18 on top of it, from wear, wrinkling, or longitudinal movement. Lower canvas 40 thus provides a surface over which upper canvas 42, with the patient on it, can be drawn toward the head of the bed 10 without patient contact and without the necessity of lifting the patient. Since the length of upper canvas 42 can be considerably greater than that of mattress 14, the operation of moving the patient toward the head of the bed can be performed a considerable number of times before it is necessary to bring the canvas back to the starting point.

It is to be understood that the present invention is not limited by the preferred embodiment described above, but encompasses any and all embodiments within the scope of the following claims.

What is claimed is:

1. An apparatus for moving a patient without lifting toward the head of a bed having a frame and a mattress thereupon, comprising:
   - a pair of head support brackets secured to said frame and extending upwardly therefrom,
   - a take-up bar rotatably mounted between said head support brackets,
   - turning means for said take-up bar,
   - an upper flexible sheet-like member having a first edge and a second edge, said first edge detachably secured to said take-up bar,
   - a pair of foot support brackets secured to said frame and extending upwardly therefrom,
   - a foot anchor bar detachably mounted between said foot support brackets,
   - a lower flexible sheet-like member disposed intermediate said upper flexible sheet-like member and said mattress, said lower sheet-like member having a head edge and a foot edge,
   - said foot edge detachably secured to said foot anchor bar, and
   - means providing tension upon said head edge to hold said lower flexible sheet-like member taut and wrinkle-free, whereby
   - longitudinal movement of said lower flexible sheet-like member is prevented as said turning means is manipulated to shift said upper sheet-like member toward said take-up bar.

2. The apparatus of claim 1 wherein said upper and lower flexible sheet-like members comprise canvas material.

3. The apparatus of claim 1 wherein said means comprises:
   - a tension rod detachably secured to said head edge of said lower sheet-like member, and
   - plural elongated elastic members connecting said tension rod to the frame of the bed and providing tension to keep said lower sheet-like member taut.

4. The apparatus of claim 1 wherein said take-up bar has a concentric bore therethrough and a longitudinal slot communicating between said bore and the exterior of said bar and includes a key bar insertable into said bore and wherein said first edge has a hem, whereby
   - said key bar may be inserted through said hem and then inserted into said bore, with said upper flexible sheet-like member extending through said slot.

5. The apparatus of claim 1 wherein said turning means for said take-up bar is motorized.

* * * * *